US007713382B2

(12) United States Patent
Lampinen et al.

(10) Patent No.: US 7,713,382 B2
(45) Date of Patent: May 11, 2010

(54) METHOD AND APPARATUS FOR PROCESSING WOOD CHIPS

(75) Inventors: Rami Lampinen, Tampere (FI); Lasse Hernesniemi, Pietarsaari (FI); Antti Tuominen, Pori (FI)

(73) Assignee: Metso Paper, Inc, Helsinki (FI)

( * ) Notice: Subject to any disclaimer, the term of this patent is extended or adjusted under 35 U.S.C. 154(b) by 171 days.

(21) Appl. No.: 11/719,639

(22) PCT Filed: Nov. 16, 2005

(86) PCT No.: PCT/FI2005/050416

§ 371 (c)(1),
(2), (4) Date: Oct. 9, 2007

(87) PCT Pub. No.: WO2006/053948

PCT Pub. Date: May 26, 2006

(65) Prior Publication Data

US 2009/0084511 A1 Apr. 2, 2009

(30) Foreign Application Priority Data

Nov. 19, 2004 (FI) ..... 20045449

(51) Int. Cl.
*D21C 1/10* (2006.01)

(52) U.S. Cl. ..... 162/52; 162/68; 162/233

(58) Field of Classification Search ..... 162/52, 162/68, 233, 246

See application file for complete search history.

(56) References Cited

U.S. PATENT DOCUMENTS

| | | | |
|---|---|---|---|
| 4,599,138 | A | 7/1986 | Lindahl |
| 6,413,367 | B1 | 7/2002 | Svedman et al. |
| 2002/0059992 | A1 | 5/2002 | Prough et al. |
| 2002/0139497 | A1 | 10/2002 | Jiang et al. |
| 2003/0000661 | A1 | 1/2003 | Henricson et al. |
| 2004/0060673 | A1 | 4/2004 | Phillips et al. |

FOREIGN PATENT DOCUMENTS

| | | | |
|---|---|---|---|
| SE | 9402229 | | 12/1995 |
| WO | 95/02726 | A1 | 1/1995 |
| WO | 00/53844 | A1 | 9/2000 |
| WO | 2006053948 | A1 | 5/2006 |

OTHER PUBLICATIONS

International Preliminary Report on Patentability issued in PCT/FI2005/050416.

International Search Report issued in PCT/FI2005/050416.

Search Report issued in foreign priority application FI20045449.

*Primary Examiner*—Mark Halpern
(74) *Attorney, Agent, or Firm*—Stiennon & Stiennon

(57) ABSTRACT

A method and an apparatus for processing wood chips, wherein the wood chips are treated with steam in a gas removal apparatus. The condensate formed in the gas removal apparatus is removed from the gas removal apparatus and the wood chips are treated with a processing solution in order to remove metal ions from the wood chips. Condensate formed in the gas removal apparatus is used as processing solution.

27 Claims, 3 Drawing Sheets

METHOD AND APPARATUS FOR PROCESSING WOOD CHIPS

CROSS REFERENCES TO RELATED APPLICATIONS

This application is a national stage application of International App. No. PCT/FI2005/050416, filed Nov. 16, 2005, the disclosure of which is incorporated by reference herein, and claims priority on Finnish App. No. 20045449, filed Nov. 19, 2004, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for processing wood chips. The invention also relates to an apparatus for implementing the aforementioned method.

When manufacturing cellulose and paper pulp, the lignocellulose-containing wood chips used as raw material are cooked in an alkaline solution in order to separate the fibres and lignin contained in them from each other. The manufacture comprises several stages, both before and after the cooking. Before cooking, the wood chips are introduced to a gas removal stage, where gases are removed from both inside the wood chips and the spaces between them by directing hot steam to the wood chips. After the gas removal stage the wood chips are directed to the impregnation stage, where cooking chemicals are impregnated to the wood chips before the wood chips are directed to the cooking stage. Cooking takes place in an elevated temperature and it takes approximately 30 to 240 minutes, depending on the raw material and the cooking temperature. After cooking the lignin is separated from the lignin-fibre mixture by washing it in one or more washing phases. The remaining fibrous pulp is led for further processing, such as, for example, bleaching. The bleaching stage is also composed of several different phases, where the pulp is processed by means of bleaching chemical and scrubbed.

Nowadays pulp mills tend to use in pulp bleaching more bleaching methods that are based on the use of oxygenous chemicals, such as oxygen, peroxide and ozone bleaching. These oxygen-based bleaching methods are both ecological and economical and their implementation is beneficial in controlling the chemical recovery cycle of the mill, especially a so-called closed chemical recovery cycle.

The wood chips directed to the pulp digester naturally comprise organic compounds formed by metal ions and inorganic salts, for example, silicates, i.e. sand. Most common are compounds and salts formed by ions of sodium, potassium, calcium, magnesium, barium, iron, copper and manganese. Under the effect of the alkaline conditions in the digester a part of the metallic cations attached to anionic groups of wood dissolve in the cooking liquor by wood reactions and dissolution, or they react directly with the cooking liquor. A part of the metal compounds in the wood chips are very poorly soluble in alkaline conditions, and move on in the pulp manufacturing process as organic compounds combined to fibres or organic or inorganic compounds precipitated to the fibres. Poorly soluble metal compounds formed in the cooking liquor, for example calcium carbonate, tend to precipitate on the heat surfaces of the heat exchangers at the digester house and the evaporation plant because their solubility product decreases when temperature rises. On the other hand, potassium, which remains soluble in alkaline environment, causes problems in the black liquor combustion after cooking, which black liquor combustion is a part of the cooking liquor regeneration process. Potassium causes problems especially in the superheater part of the recovery boiler, by forming potassium chloride, which adheres to the steam tubes and is corrosive in high temperatures. Because of this the steam pressure and temperature of the recovery boiler must be lowered when the raw material of the pulp is chloridic wood chips. As a result of this the electricity production of the recovery boiler decreases and thus causes economic losses. Metals combined to the pulp, especially transition elements, cause problems in the bleaching performed later by means of oxygenic chemicals of the pulp. Metal ions for example catalyze the decomposition of oxygenic chemicals. Consequently, in order to reach the desired bleaching result, the chemical must be used in excess in the bleaching. This increases the chemical costs of bleaching. In addition, the metal ions catalyze side reactions that cut the cellulose fibres and thus cause pulp loss and deteriorated quality both in cooking and bleaching. They also cause the coloring of bleached pulp, mostly yellowing during storage. Further, metal ions, especially calcium ions together with the chemicals in the pulp suspension, form precipitations on the walls of the pulp production and finishing apparatuses, which precipitations cause clogs in the process apparatuses, as well as spotting of the finished pulp and other fouling.

Therefore, nowadays the aim is to remove metal ions from pulp in various ways. It is very common to remove metal ions from pulp coming from cooking by processing the pulp before the bleaching stage in a special metal removal stage, i.e. chelating stage (Q-stage). In this stage the pulp is washed with an acidic solution, to which a compound that is able to form complexes, i.e. chelates with the metal ions in the pulp has been added. Suitable chelating agents are, for example, ethylene diamine tetra acetic acid (EDTA) and diethylene triamine penta acetic acid (DTPA). These reagents are water soluble, easily soluble and commercially available. Another alternative is to wash the pulp after the acidic bleaching stage, in which case the metal ions remain in the washing water.

It has also been suggested that metal ions are removed from wood chips before they are directed to cooking. A method of this type is disclosed in patent application FI 20021152 (the corresponding US application 2003/0000661), where after the steaming of the wood chips, which takes place before cooking, the wood chips are treated with warm water solution. The water solution used includes water, condensate of the wood chip steamer or other condensate from the mill, rainwater or wastewater from the bleacher. As can be learned from the publication, this method is applicable only in removing potassium ion-containing compounds. The other metal ions in the wood chips do not react to this treatment and therefore remain in the wood chips.

Another method is disclosed in publication U.S. Pat. No. 6,413,367, wherein metal ions in the wood chips are removed by chelating chemicals used in producing pulp by the batch cooking method. According to the method during the packing of the digester is packed with wood chips, DTPA-containing water solution is fed to the steam used in packing the wood chips. DTPA forms chelates with the metal ions in the wood chips and the formed chelates are removed from the digester with the black liquor removed in the black liquor processing stage following the chelating stage. The solution according to the publication does remove the problems caused by metal ions in connection with pulp cooking and processing, but it transfers them to the processing of black liquor. That is, the chelates formed by the DTPA decompose in high temperatures. The metal chelates removed from the digester with black liquor end up at the evaporation plant, where they decompose and cause problems there by precipitating on the heat delivery surfaces.

SUMMARY OF THE INVENTION

The purpose of the present invention is to provide a method for processing wood chips, by means of which the above-presented problems can be avoided and the metal ions contained in the wood chips can be removed in a simple and easy manner before the cooking phase of pulp. It is also an aim of the invention to provide an apparatus implementing the aforementioned method.

The invention is based on the idea that the wood chips introduced to the digester are treated with processing solution before the impregnation stage and the cooking stage, which solution removes the metal ions in the wood chips. Condensate formed in the gas removal apparatus of wood chips can be used as processing solution as such, or the processing solution can be condensate formed in the gas removal apparatus, to which a chemical that is able to form chelates with metal ions has been added. Processing with this solution takes place in connection with the gas removal of wood chips, either before the gas removal and/or after it. Advantageously the wood chips are brought in contact with the processing solution in two phases, the first one of which is placed immediately before the wood chips gas removal and the second immediately after the gas removal.

Gas removal from the wood chips takes place by introducing hot steam to the wood chips. According to the invention the condensate formed in the gas removal apparatus is recovered and used as processing solution. If desired, it is possible to add to the condensate a chemical that is able to form chelates with metal ions, in which case a processing solution comprising a chelating chemical is created, which solution is used in removing metal ions from the wood chips. The first removal treatment for removing metal ions from wood chips, i.e. the one taking place before transferring wood chips to the gas removal stage, is performed either in a processing tank placed immediately before the gas removal device or simultaneously when transferring wood chips to the gas removal device. Thus, the wood chips conveying means is formed in such a manner that it is suitable for treatment for removing metal ions from the wood chips. The conveying means can be, for example, a waterproof screw conveyor, to which the processing solution is fed.

Immediately after the gas removal the wood chips are treated in a second treatment for removing metal ions. Wood chip treatment may take place in a processing tank placed immediately after the gas removal device or simultaneously with the wood chips are transferred to the next processing stage of the pulp production process, such as the impregnation stage. Thus, the wood chips conveying means is formed in such a manner that it is suitable for treatment for removing metal ions from the wood chips. It can be, for example, a waterproof screw conveyor, as was already mentioned above.

The invention utilizes the condensate formed in the gas removal device in a new and excellent manner by utilizing it as processing solution, which is used in removing the metal ions comprised by the wood chips. In this manner the condensate is put into practical use and there is no need to lead water from elsewhere in order to form the processing solution. If the processing solution is formed of the condensate formed from the gas removal apparatus and the chelating chemical, it is possible to use as chelating chemicals, for example, EDTA and DTPA, which dissolve well in water. They can therefore be introduced directly to the condensate, and separate mixing apparatuses are not needed in mixing them.

By means of the method and apparatus according to the invention, most of the harmful metal ions that come with the wood chips can be removed already before the wood chips are directed to cooking. Thus, the pulp coming to bleaching from the cooking contains less metal ions that decompose bleaching chemicals, which means that the amount of bleaching chemicals needed is smaller and the chemical expenses of the mill are decreased. The decrease in the amount of metal ions has positive effects on cooking as well, because it is more selective and the pulp yield from the cooking is greater. In addition, the usability and energy economy of the digester house and the other process devices taking part in the processing of pulp and liquor separated from the pulp is better, because less precipitations are formed on the heat delivery surfaces of the devices due to the smaller metal ion content, especially calcium content, and corrosion problems decrease.

In the following, the present invention will be described in more detail with reference to the appended figures, in which

DESCRIPTION OF THE PREFERRED EMBODIMENTS

The term metal ion used in this description refers not only to metal ions in an ion form, but also to the silicates, organic compounds and inorganic salts formed by metal ions. Especially compounds formed by sodium, potassium, calcium, magnesium, barium, iron, copper and manganese ions and salts are possible.

Figure 1:
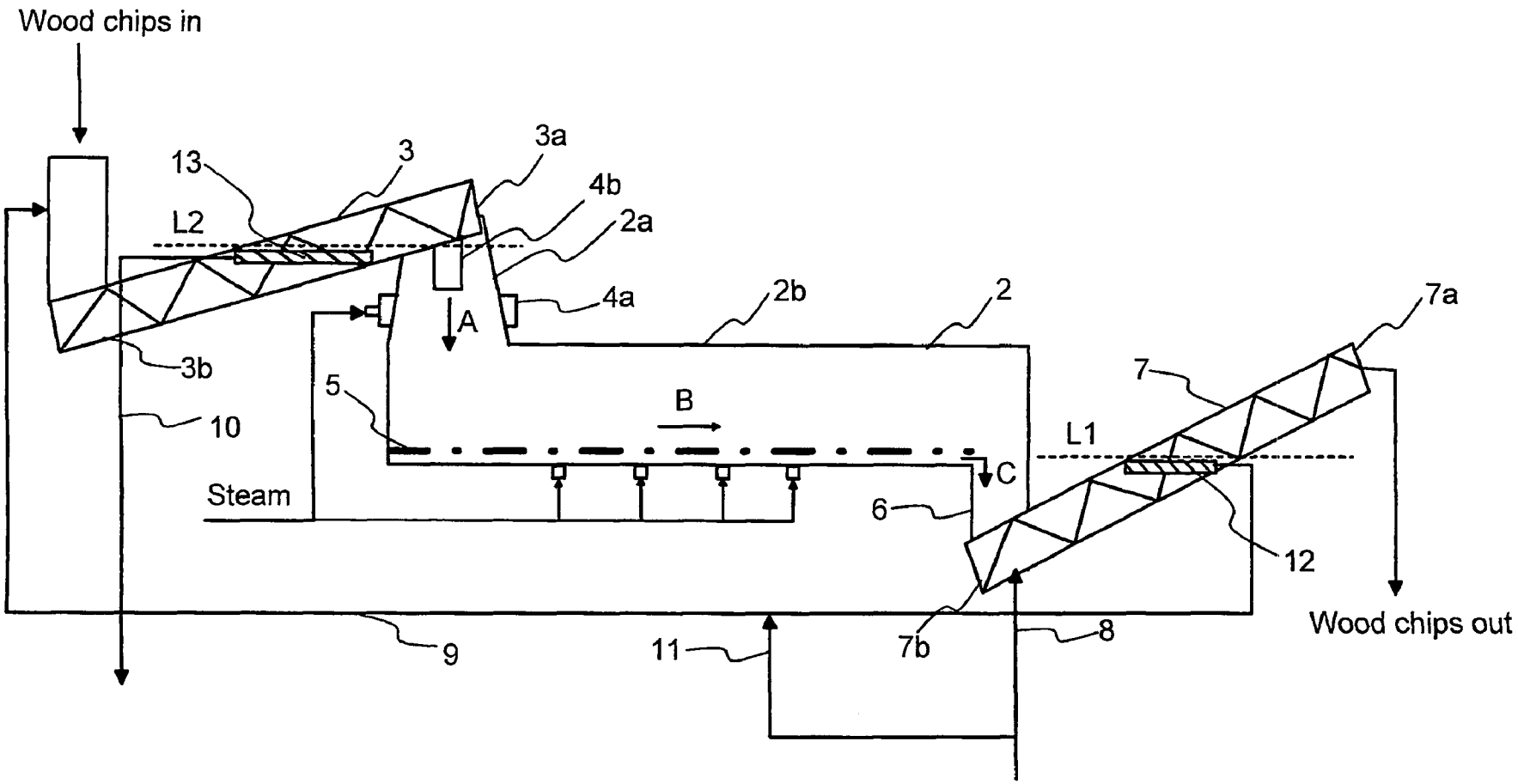
FIG. 1 shows schematically an apparatus according to the invention for processing wood chips in a side view and in a partial cross-section.

FIG. 1 shows in a very simplified manner an apparatus according to the invention, which is suitable for processing wood chips.

The wood chip processing apparatus 1 comprises a gas removal apparatus 2, wherein the removal of gases inside the wood chips and in their interspace takes place. Wood chips are fed to the gas removal device 2 by means of a first conveyor means, for example a screw conveyor 3 from the wood chip storage bin or directly from chipping (not shown in the figure) .

In an embodiment of the invention shown in FIG. 1 the gas removal apparatus 2 is formed in such a manner that it comprises two phases, the wood chip heating phase and the gas removal phase. In the first phase, the wood chip heating phase, the wood chips are introduced to the vertical heating part 2*a* from its upper end. The wood chips move in the heating part by means of gravity vertically downward according to the arrow A. Hot steam is directed to the heating part crosswise with respect to the wood chip flow from steam feeding pipes 4*a* and 4*b*. The feeding pipes are equipped with steam distribution means, for example screens to distribute the steam evenly to the wood chip flow in its cross-direction. In this manner, the efficient heating of wood chips to the gas removal temperature or at least close to it is ensured. In the heating part 2*a* the wood chip flow becomes dense and it is discharged to the gas removal part 2*b* located in connection with the heating part, thus forming a dense bed on top of a conveyor 5 arranged at the bottom of the horizontal gas removal part. In the gas removal phase a sufficient delay time is ensured for the wood chips so that the gas removal from inside the wood chip particles would be as complete as possible. In the gas removal part the wood chip bed is conveyed substantially on the horizontal plane as shown by the arrow B through the gas removal part 2*b* by means of the conveyor 5 located below the wood chip bed. Hot steam is introduced to the gas removal part through nozzles arranged on the bottom of the gas removal part 2*b*. Steam penetrates to the wood chip bed via holes arranged in the conveyor. In this manner, a suitable temperature required by gas removal is maintained in the wood chip bed.

The wood chips treated in the gas removal apparatus are discharged through a duct 6 integrated to the gas removal part 2*b*, which duct also operates as a condensate removal duct. The wood chips are removed from the gas removal apparatus from the lower end of the duct 6 by another conveyor means, a wood chips discharging conveyor means that is in connection with the duct 6, for example a screw conveyor 7. The screw conveyor discharges the wood chips to the next processing stage, such as the cooking chemical impregnation stage or cooking stage (not shown in the figure).

The condensate forming in the gas removal apparatus 2 accumulates on the bottom of the gas removal part 2*b*, below the conveyor 5, and it is directed via the duct 6 to the screw conveyor 7 that is in fixed connection with the gas removal part 2*b*. The condensate flow is indicated schematically in the figure with the arrow C. The screw conveyor 7 is arranged in an upward inclined position in such a manner that the discharge end 7*a* of the screw conveyor is higher than the feed end 7*b* of the screw conveyor. The discharge end 7*a* of the screw conveyor is the end of the conveyor that is discharging wood chips off from the screw conveyor. The feed end 7*b* of the screw conveyor is the end of the conveyor that receives the wood chips for conveying. The screw conveyor 7 is waterproof, in which case it collects the condensate, i.e. the processing solution, directed there, which solution forms a liquid level L1 in the screw conveyor 7, which is indicated by a dashed line in FIG. 1. The height of the liquid level L1 settles on the upper part of the screw conveyor in relation to the length of the screw conveyor. The wood chips discharged from the gas removal apparatus 2 are thus treated with the processing solution when they move towards the discharge end 7*a* of the screw conveyor due to the movement of the screw conveyor. In other words, the wood chips are conveyed through the liquid formed by the processing solution.

The figure also shows an embodiment of the invention, where the processing solution is formed by adding to the condensate a chemical that forms chelates with metal ions. The chelating chemical is thus fed to the feed end 7*b* of the screw conveyor 7 through line 8. The chelating chemical mixes with the condensate forming a processing solution containing a chelating chemical on the screw conveyor, through which the wood chips are conveyed.

A screen 12 has been arranged directly below the liquid level L1 in the upper part of the screw conveyor 7. Through the screen 12 the processing solution is removed from the screw conveyor 2 via line 9 to the wood chips feeding screw conveyor 3 preceding the gas removal stage and feeding wood chips to the gas removal device 2. The screw conveyor 3 is arranged in an upward inclined position in such a manner that the discharge end 3*a* of the screw conveyor feeding wood chips from the screw conveyor to the gas removal device 2 is higher than the feed end 3*b* of the screw conveyor, where the wood chips to be conveyed by the screw conveyor are fed. The screw conveyor 3 is also formed waterproof, and the processing solution fed to it forms a liquid level L2 indicated by a dashed line on the screw conveyor 3. The level of the liquid in the screw conveyor is controlled by removing processing solution via the screen 13 below the liquid level L2 and the line connected to it, i.e. the discharge pipe 10. The height of the liquid level L2 is preferably adjusted in relation to the length of the screw conveyor in such a manner that the wood chips conveyed on the screw conveyor come in contact with the processing solution over almost the entire conveying length of the screw conveyor. The processing solution removed from the screw conveyor is directed to a separate solution processing system. The wood chips are treated with the processing solution when they move along with the movement of the screw conveyor towards the discharge end 3*a* of the screw conveyor 3. The wood chips are thus in contact with the processing solution throughout the entire time they are below the liquid level during conveying by the screw conveyor towards the gas removal apparatus 2. The screw conveyor 3 is arranged in connection with the gas removal device in such a manner that from the discharge end 3*a* of the screw conveyor the wood chips are discharged directly to the gas removal device 2. If desired, the liquid level L2 can also be adjusted so high that a part of the processing solution on the screw conveyor flows to the gas removal device 2 together with the wood chips.

As can be seen from the advantageous embodiment of the above-presented invention, the wood chips are treated in two steps with the processing solution in connection with the gas removal of the wood chips. The first step in the travel direction of the wood chips is on the screw conveyor 3 and the second step is on the screw conveyor 7. Advantageously these two steps are located directly before or after the gas removal phase. Because the wood chips to be treated are conveyed trough the processing solution in the screw conveyor, each piece of wood comes in contact with the processing solution and thus receives a treatment with the chelating liquid. Thus, this embodiment of the invention gives a better end result than, for example, such a solution where the processing solution would be simply sprayed on the wood chip bed. If a chemical that forms chelates with metal ions of the wood chips is used as processing solution, the chelating chemical can, if necessary, be added to the condensate collected from the gas removal device and to the chelating processing solution formed of it through the duct 11 in the line 9 as well.

Figure 2:
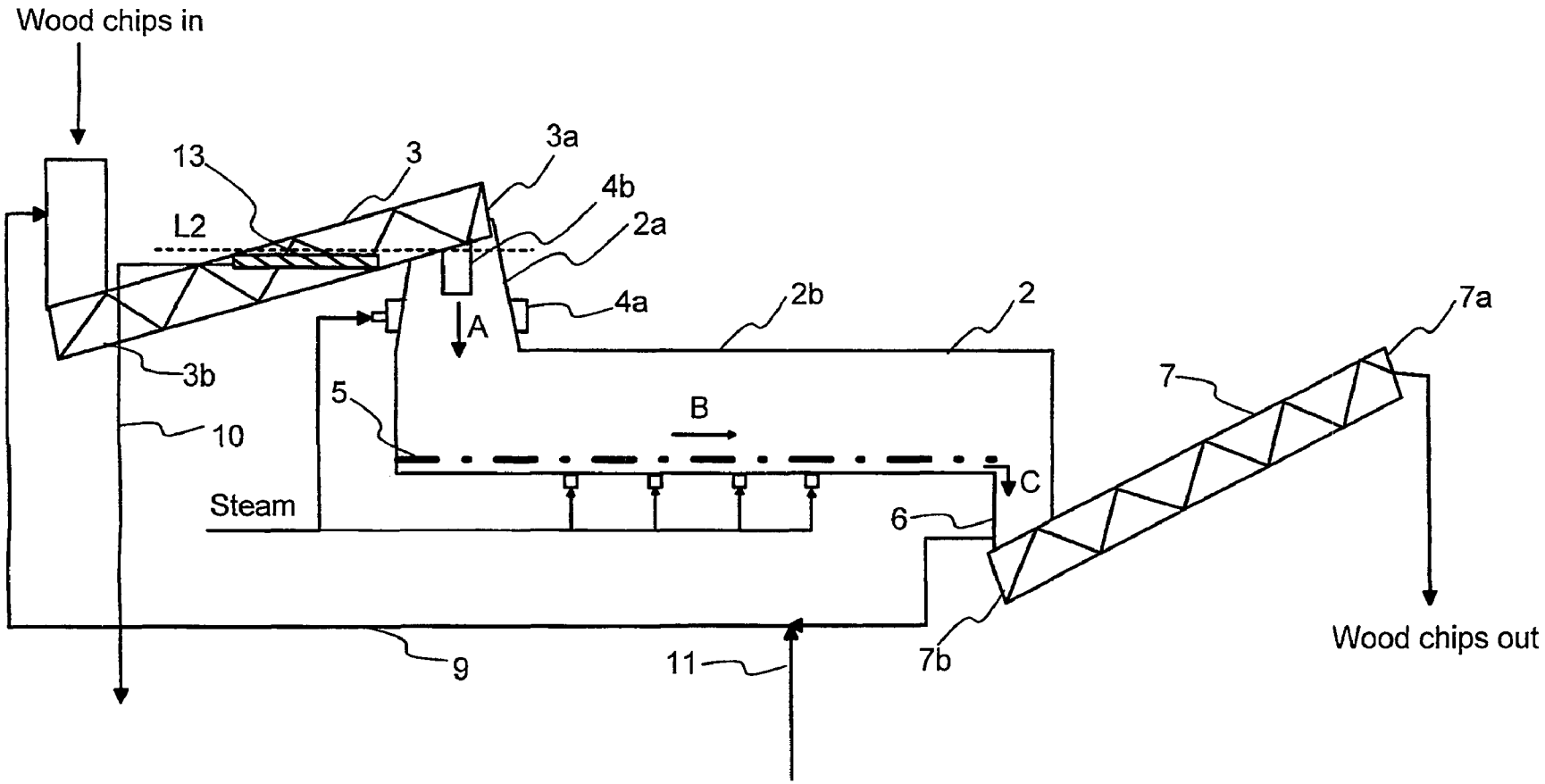
FIG. 2 shows schematically another apparatus according to the invention for processing wood chips in a side view and in a partial cross-section.

According to an embodiment of the invention, the wood chips are treated with the processing solution only immediately before the gas removal stage, which application is shown in FIG. 2. The condensate formed in the gas removal apparatus 2, i.e. the processing solution is directed via duct 6 to the transfer line 9 connected to the gas removal part 2*b*, and through that further to the waterproof screw conveyor 3, wherein the liquid level L2 according to what is presented above is formed. The liquid level L2 is adjusted by removing processing solution via the screen 13 to the line 10. Thus, wood chip processing takes place only when chips are conveyed on the screw conveyor 3 to the gas removal device 2. Thus, a liquid level is not formed on the screw conveyor 7, but it conveys the wood chips from the gas removal device 2 directly forward as such. When a liquid containing a chemical that chelates metal ions is desired to be used as the processing solution, the chelating chemical is directed to the transfer line 9 from the duct 11.

Figure 3:
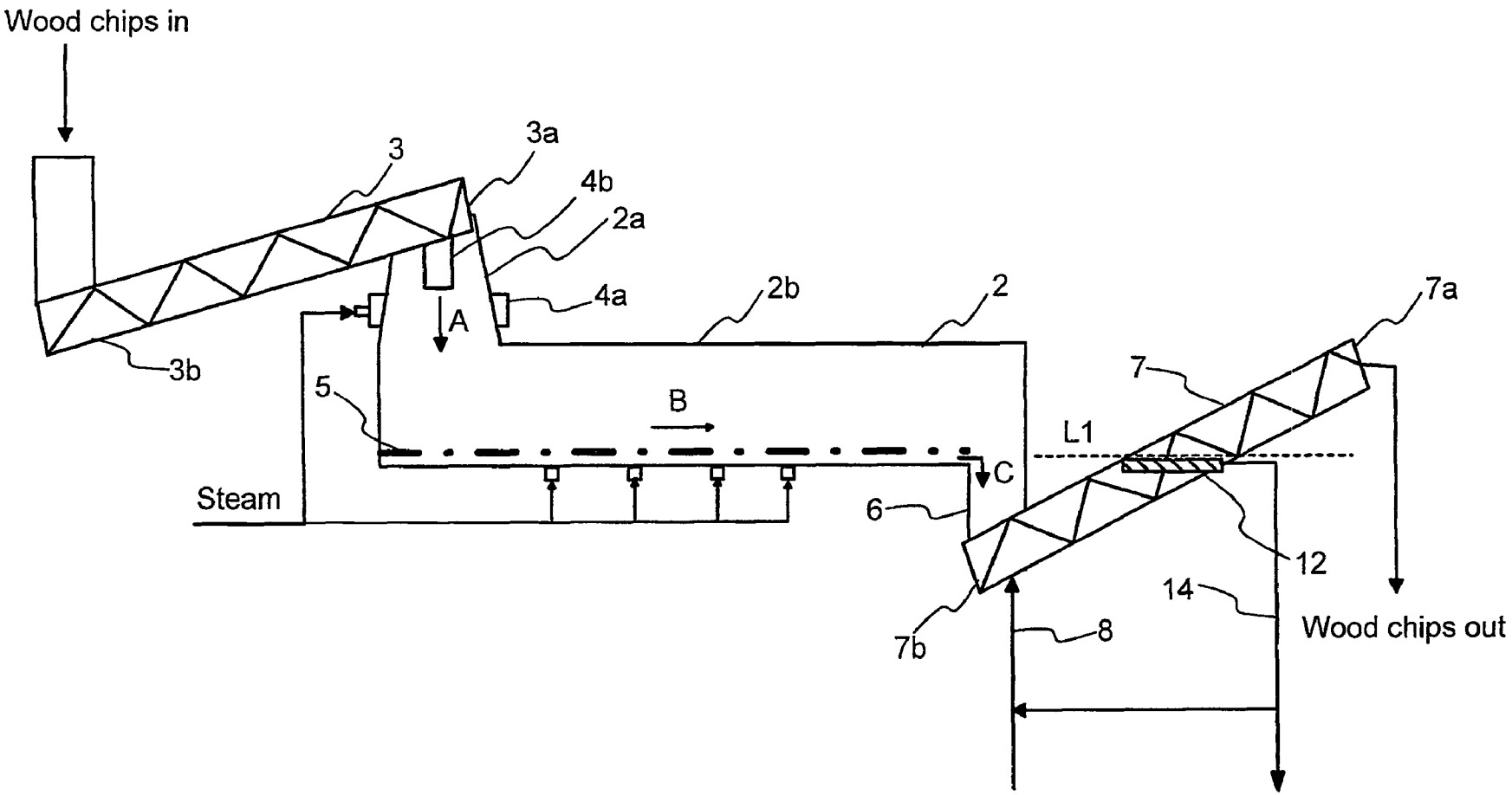
FIG. 3 shows schematically a third apparatus according to the invention for processing wood chips in a side view and in a partial cross section.

According to an embodiment of the invention, which is shown in FIG. 3, the wood chips are treated with the processing solution only immediately after the gas removal phase 2. The condensate formed in the gas removal apparatus 2, i.e. the processing solution is collected, as is shown in the embodiment according to FIG. 1, in the waterproof screw conveyor that is in a fixed connection with the gas removal part 2*b*. A liquid level L1 of the processing solution is formed in the screw conveyor 7. The wood chips discharged from the gas removal apparatus 2 are thus treated with the processing solution when they move along with the movement of the screw conveyor towards the discharge end 7*a* of the screw conveyor. Thus, the screw conveyor 3 operates only as a conveyor feeding the gas removal device 2 with wood chips. The liquid level in the screw conveyor 7 is adjusted by removing processing solution from the screw conveyor 7 through the line 14 connected to the screen 12. In this embodiment, when a liquid containing a chemical that chelates metal ions is desired to be used as the processing solution, the chelating chemical is directed to the screw conveyor 7 through the line 8. If desired, the processing solution containing chelating chemical can also be recycled from the screen 12 to the line 8 directing the chelating chemical to the screw conveyor.

In connection with all the above-presented embodiments it is also possible to feed the chelating chemical directly to the gas removal device 2. Thus, the chelating chemical is fed to the heating part 2*a* of the gas removal device, together with the steam fed via the steam feeding pipe 4*b* to the wood chips.

The invention is not intended to be limited to the embodiments presented as examples above, but the invention is intended to be applied widely within the scope of the inventive idea as defined in the appended claims. It is naturally possible to use also other solutions than the condensate created in the gas removal stage or a mixture of the condensate and chelating chemical as the processing solution. Any liquid, such as, for example water or other condensates from a pulp mill are suitable for the liquid phase required for forming the processing solution.

What is claimed is:

1. A method of removing metal ions from wood chips, comprising the steps of:

conveying the wood chips along a first upwardly extending conveyor;

de-aerating the wood chips with steam from a steam feed in a second conveyor arranged to convey the wood chips substantially on a horizontal plane, so that the second conveyor forms a gas removal apparatus;

forming and collecting a condensate liquid from the steam used to de-aerate the wood chips on the second conveyor;

conveying the wood chips in a third conveyor that extends upwardly from the second conveyor, wherein at least one of the first conveyor and the third conveyor is partially filled with the collected condensate liquid from the steam used to de-aerate the wood chips on the second conveyor, such that the wood chips conveyed upward through the condensate liquid partially filling the first conveyor or the third conveyor and metal ions are removed.

2. The method of claim 1, wherein the first conveyor is waterproof and the wood chips are treated with the condensate liquid in the first conveyor.

3. The method of claim 1, wherein the third conveyor is waterproof and the wood chips are treated with the condensate liquid in the third conveyor.

4. The method of claim 1, wherein the first conveyor is waterproof, the third conveyor is waterproof, and wherein the steam used to de-aerate the wood chips in the second conveyor is condensed in the second conveyor to form the condensate liquid and collected by draining out of the second conveyor in to the third conveyor to partially fill the third conveyor with the condensate liquid; and further comprising the step of:

removing the condensate liquid after it has partially filled the third conveyor, and supplying the condensate liquid by a transfer line to also partially fill the first conveyor so that the wood chips are fed to the second conveyor forming the gas removal apparatus through the condensate liquid.

5. The method of claim 4, wherein a chemical that chelates metal ions is added to the transfer line which transfers the condensate from the third conveyor to the first conveyor.

6. The method of claim 4, wherein the first conveyor is a screw conveyor and has a first length and the third conveyor is a screw conveyor and has a third length and wherein the condensate liquid is raised in the first conveyor to a height to fill more than half of the first length of the first conveyor, and wherein the condensate liquid is raised in the third conveyor to a height to fill more than half of the third length of the third conveyor.

7. The method of claim 1, further comprising the step of adding a chemical that chelates metal ions to the condensate liquid formed in and collected from the gas removal apparatus, before the condensate liquid is used to partially fill the first conveyor or the third conveyor.

8. The method of claim 7, wherein the chemical that chelates metal ions is ethylene diamine tetra acetic acid or diethylene triamine penta acetic acid.

9. The method of claim 1, wherein the condensate liquid formed in the second conveyor is collected in the third conveyor and a chemical that chelates metal ions is added to the condensate collected therein.

10. The method of claim 1, wherein a chemical that chelates metal ions is added to the steam fed to the second conveyor forming the gas removal apparatus.

11. The method of claim 1, wherein the metal ions removed are at least one ion selected from the group consisting of sodium, potassium, calcium, magnesium, barium, iron, copper and manganese ions.

12. The method of claim 1, wherein the wood chips are directed to cooking from the third conveyor.

13. A method of removing metal ions from wood chips, comprising the steps of conveying the wood chips along an upwardly extending first conveyor of the screw type, the first conveyor having an upper end;

receiving the wood chips from the upper end of the first conveyor into a second conveyor and de-aerating the wood chips with steam from a steam feed wherein the second conveyor is arranged to convey the wood chips substantially on a horizontal plane, so that the second conveyor forms a gas removal apparatus;

forming and collecting a condensate liquid from the steam used to de-aerate the wood chips on the second conveyor;

receiving the wood chips from the second conveyor in to a lower end of a third conveyor of the screw type, the third conveyor extending upwardly from the second conveyor, wherein the third conveyor is filled to a liquid level in a upper end of the third conveyor with the collected condensate liquid from the steam used to de-aerate the wood chips on the second conveyor, such that the wood chips are conveyed upward through the condensate liquid in the third conveyor, so that metal ions are removed from the wood chips;

receiving the condensate liquid from the third conveyor through a transfer line in to the first conveyor;

wherein the first conveyor is filled to a liquid height with the condensate liquid, which is received from the transfer line after passing through the third conveyor, such that the wood chips are conveyed upward through the condensate liquid partially filling the first conveyor, and further metal ions are removed from the wood chips.

14. The method of claim 13, further comprising the step of adding a chemical that chelates metal ions to the condensate liquid formed in and collected from the gas removal apparatus, before the condensate liquid is used to partially fill the first conveyor.

15. The method of claim 14, wherein the chemical that chelates metal ions is ethylene diamine tetra acetic acid or diethylene triamine penta acetic acid.

16. The method of claim 13, wherein the condensate liquid formed in the second conveyor is collected in the third conveyor and a chemical that chelates metal ions is added to the condensate collected therein.

17. The method of claim 13, wherein a chemical that chelates metal ions is added to the transfer line which transfers the condensate from the third conveyor to the first conveyor.

18. The method of claim 13, wherein a chemical that chelates metal ions is added to the steam fed to the second conveyor forming the gas removal apparatus.

19. The method of claim 13, wherein the metal ions removed are at least one ion selected from the group consisting of sodium, potassium, calcium, magnesium, barium, iron, copper and manganese ions.

20. The method of claim 13, wherein the first conveyor is filled to a liquid height with the condensate liquid, which is received from the transfer line after passing through the third conveyor, in such a manner that the wood chips conveyed on the first conveyor come in contact with the processing solution over almost the entire conveying length of the first conveyor.

21. A method of removing metal ions from wood chips, comprising the steps of:

conveying the wood chips along a first upwardly extending conveyor, having an upper end;

conveying the wood chips along a second conveyor positioned below the upper end of the first conveyor and de-aerating the wood chips with steam from a steam feed wherein the second conveyor is arranged to convey the wood chips substantially on a horizontal plane, so that the second conveyor forms a gas removal apparatus;

forming and collecting a condensate liquid from the steam used to de-aerate the wood chips on the second conveyor;

feeding the wood chips from the second conveyor downwardly into a third conveyor that extends from below the second conveyor upwardly to above the second conveyor, wherein at least one of the first conveyor and the third conveyor is partially filled with the collected condensate liquid from the steam used to de-aerate the wood chips on the second conveyor, such that the wood chips are conveyed upward through the condensate liquid partially filling the first conveyor or the third conveyor and such that metal ions are removed from the wood chips.

22. The method of claim 21, wherein the first conveyor is waterproof, the third conveyor is waterproof, and wherein the steam used to de-aerate the wood chips in the second conveyor is condensed in the second conveyor to form the condensate liquid and collected by draining out of the second conveyor in to the third conveyor to partially fill the third conveyor with the condensate liquid; and further comprising the step of:

removing the condensate liquid after it has partially filled the third conveyor, and supplying the condensate liquid by a transfer line to also partially fill the first conveyor so that the wood chips are fed to the second conveyor forming the gas removal apparatus through the condensate liquid.

23. The method of claim 22, wherein a chemical that chelates metal ions is added to the condensate collected in the third conveyor.

24. The method of claim 22, wherein a chemical that chelates metal ions is added to the transfer line which transfers the condensate from the third conveyor to the first conveyor.

25. The method of claim 22, wherein the first conveyor is a screw conveyor and has a first length and the third conveyor is a screw conveyor and has a third length and wherein the condensate liquid is raised in the first conveyor to a height to fill more than half of the first length of the first conveyor, and wherein the condensate liquid is raised in the third conveyor to a height to fill more than half of the of third length of the third conveyor.

26. The method of claim 21, further comprising the step of adding a chemical that chelates metal ions to the condensate liquid formed in and collected from the gas removal apparatus, before the condensate liquid is used to partially fill the first conveyor or the third conveyor.

27. The method of claim 21, wherein a chemical that chelates metal ions is added to the steam fed to the second conveyor forming the gas removal apparatus.

* * * * *